US005628402A

United States Patent [19]

Dickie et al.

[11] Patent Number: 5,628,402

[45] Date of Patent: *May 13, 1997

[54] GAS-CONTAINING PRODUCT SUPPORTING STRUCTURE

[75] Inventors: Robert G. Dickie; Michael D. Clee, both of Newmarket, Canada

[73] Assignee: Intepac Technologies Inc., Toronto, Canada

[ * ] Notice: The term of this patent shall not extend beyond the expiration date of Pat. No. 5,626,229.

[21] Appl. No.: 471,962

[22] Filed: Jun. 6, 1995

Related U.S. Application Data

[63] Continuation of Ser. No. 196,792, Feb. 15, 1994, which is a continuation of Ser. No. 128,265, Sep. 28, 1993, abandoned, which is a continuation of Ser. No. 851,333, Mar. 16, 1992, abandoned, which is a continuation-in-part of Ser. No. 612,239, Nov. 5, 1990, abandoned.

[51] Int. Cl.[6] ..... B65D 81/02; B65D 85/30

[52] U.S. Cl. ..... 206/521; 206/522; 206/591

[58] Field of Search ..... 206/522, 521, 206/591, 592, 594

[56] References Cited

U.S. PATENT DOCUMENTS

| | | | |
|---|---|---|---|
| 3,366,231 | 1/1968 | Trakas | 206/0.5 |
| 3,403,713 | 10/1968 | Good et al. . | |
| 3,514,157 | 5/1970 | Geiser | 298/22 |
| 3,552,466 | 1/1971 | Fairchilds | 150/0.5 |
| 3,889,743 | 6/1975 | Presnick | 165/46 |
| 3,949,879 | 4/1976 | Peterson et al. | 206/522 |
| 4,091,852 | 5/1978 | Jordan et al. | 150/0.5 |
| 4,103,810 | 8/1978 | Hickey | 224/29 |
| 4,551,379 | 11/1985 | Kerr | 428/200 |
| 4,793,123 | 12/1988 | Pharo | 53/449 |
| 4,801,213 | 1/1989 | Frey et al. | 383/3 |
| 4,869,939 | 9/1989 | Santo | 428/35 |
| 4,874,093 | 10/1989 | Pharo | 206/522 |
| 4,905,835 | 3/1990 | Pivert et al. | 206/522 |
| 5,030,501 | 7/1991 | Colvin et al. | 428/178 |
| 5,184,727 | 2/1993 | Dickie et al. | 206/522 |
| 5,351,829 | 10/1994 | Batsford | 206/552 |
| 5,480,029 | 1/1996 | Batsford | 206/522 |

FOREIGN PATENT DOCUMENTS

| | | |
|---|---|---|
| 0325070 | 7/1989 | European Pat. Off. . |
| 0398345 | 5/1990 | European Pat. Off. . |
| 398345A | 5/1990 | European Pat. Off. . |
| 4034038 | 4/1992 | Germany . |
| 9205804 | 9/1992 | Germany . |
| 23965 | of 1898 | United Kingdom . |

*Primary Examiner*—B. Dayoan
*Attorney, Agent, or Firm*—Donald E. Hewson

[57] ABSTRACT

A supporting structure for positioning a product within an outer shipping container takes the form of a plastic bladder shaped on one side to provide a cavity having internal dimensions matching external dimensions of the product and shaped on the other to have external dimensions matching internal dimensions of the shipping container. The air bladder may be either a vertical or a horizontal positioning elements and is typically used pairs within a single container. The air bladder is compact and can be discarded after use with minimal environment impact. In examples shown, the air bladder is of a plastic material such as polyethylene and is produced by blow molding, making it particularly suitable for disposal after use by a recycling process, thereby further reducing potential environmental impact.

19 Claims, 6 Drawing Sheets

GAS-CONTAINING PRODUCT SUPPORTING STRUCTURE

CROSS REFERENCED APPLICATIONS

This application is a continuation application of U.S. application Ser. No. 08/196,792, filed Feb. 15, 1994, which is a File Wrapper Continuation application of application Ser. No. 08/128,265 filed Sep. 28, 1993 (now abandoned) which is a File Wrapper Continuation of U. S. application Ser. No. 07/851,333 filed Mar. 16, 1992 (now abandoned), which is a continuation-in-part application of Ser. No. 07/612,239 filed Nov. 5, 1990 (now abandoned).

TECHNICAL FIELD

This invention relates generally to product support packaging inserts and more particularly to ecologically advantageous packing inserts for supporting products within outer shipping cartons and protecting the supported products against external shock.

BACKGROUND OF THE INVENTION

When shipping fragile products, it is desirable to provide protection against external shock which is as complete as possible and, at the same time, minimize both packaging and shipping costs. In the past, both expanded polystyrene (EPS or styrofoam) and polyurethane or polyethylene (flexible foam) inserts have been used for such purposes with considerable success. In recent years, however, environmental concerns over both EPS and flexible foams have been growing. Both are very voluminous per pound and thus tend to exhaust landfill areas much too quickly. Any foamed plastic product is, moreover, both difficult and costly to reclaim or recycle back to its original non-foamed state. There is, therefore, an ongoing need for new packaging techniques which not only provide adequate protection to products against external shock and minimize both packaging and shipping costs but also present minimal ecological problems in the disposal of packaging materials after they have served their intended purpose.

SUMMARY OF THE INVENTION

The present invention generally takes the form of a supporting structure for positioning and supporting a product within an outer packing container. In accordance with a principal aspect of the invention, that structure is self-supporting and is also capable of supporting loads thereon, thus becoming a main supporting element, and further uses a gas such as air as the other main supporting element. In the preferred embodiment, the supporting structure comprises a product specific gas-containing bladder or air bladder with an external cavity on one side or in a first region thereof. The cavity is shaped to fit the external pre-determined configuration and dimensions of the product and with its exterior on the other side or in a second opposed region shaped to fit internal dimensions of the packing container or shipping carton. The air bladder may be either a vertical or a horizontal positioning element and may typically be used in sets of top and bottom pairs within a single outer packing container. The air bladder provides both product support and impact protection during storage and shipping and can be easily collapsed after use. Collapsed, the air bladder is compact and can be re-used indefinitely before it is finally re-cycled, and need not be discarded, thus minimizing environmental impact. Before final assembly for shipping, air bladder materials require relatively little storage space and even formed air bladders can themselves be stored either wholly or partially deflated to save space.

For purposes of this patent application, use of the term "inflated" to refer to gas within an air bladder or other gas-containing bladder shall mean that there is gas within the bladder. The gas may be at ambient pressure (zero gauge pressure), or somewhat above or below zero gauge pressure. Generally, the bladder is not purposely inflated or pressurized above atmospheric pressure, either during manufacture or at the time of use. Correspondingly, the term deflated shall mean that the bladder has been collapsed, with a small amount of gas remaining therein. Likewise, semi-inflated or semi-deflated means that the bladder is in a partially collapsed condition with a corresponding amount of gas therein.

In accordance with another aspect of the invention, the air bladder is composed of a plastic resin material such as polyethylene, and is produced by blow molding. Blow molding involves extruding a semi-solid tube of the plastic material into a mold having the product's outer wall shape. After the mold is closed, a jet of air from a nozzle forces the plastic material to expand and contact the metal walls of the mold. The plastic resin is cooled and hardened almost instantly as the mold is kept cool by circulating water through built-in internal cavities. Blow molding is well know and is already the process of choice in the manufacture of many commercial products such as large soft drink bottles, gas cans, and even garbage cans. Use of blow molded plastic material is particularly advantageous environmentally with respect to the present invention in that the materials it makes use of may be recycled with a minimum of cost or inconvenience. There are, furthermore, no environmentally hazardous substances or expansion agents which are used in the manufacturing process. Moreover, the material of the air bladder itself can be made up with virtually 100% recyclable material, due to modern recycling techniques.

In accordance with an important aspect of the invention, the air bladder may contain a plurality of interior chambers or compartments. Such interior chambers, when present, provide location controllable damping by way of separate air shock absorbers in areas such as corners subject to potentially higher impacts. When a passage is provided between one chamber and another, the size of the passage is controlled by baffling and has a direct influence on the rapidity with which those chambers will deflate under load. A high degree of controllable damping is thus provided. Alternatively, multiple air bladder chambers may be entirely sealed from one another in order to provide maximum isolation if needed to meet directional load requirements. When air bladder chambers are sealed from one another in this manner, the blow molding process makes use of a separate inflation nozzle for each chamber. This aspect of the invention adds yet another controllable design element to protective packaging technology, allowing smaller and effective protective packing containers or shipping cartons.

Damping is also realized due to the increased pressure of the gas within the bladder. Special gases such as sulphur hexafluoride may be used to maximize the damping capacity of the gas. Further, damping is also obtained as a result of the resiliency of the plastic that constitutes the air bladder and also from the relatively small amount of elasticity of that plastic. In terms of damping, it is detrimental to have too much elasticity in the plastic material because this amount of elasticity could cause motion to be returned to the product being supported. Other gases that may be used include carbon dioxide, nitrogen, argon and krypton.

In accordance with yet another aspect of the invention, the air bladder may be further inflated with air or other gases as desired either before or after the air bladder has been sealed, and even after assembly of the product and the air bladder within the packing container. The air bladder may thus, when required, be only partially inflated or even fully deflated after manufacture, allowing the air bladder to take up less room during shipping of the air bladder per se and also making final assembly of the product and one or more air bladders within the container easier to accomplish. After final assembly, inflation needles can be forced through the outer container at one or more predetermined inflation points, where they penetrate the designated air bladder chambers and inflate them to designated pressure levels.

The supporting structure is a semi-rigid self supporting monolith that is made from relatively thick polyethylene plastics material or similar, preferably by a blow molding process. The structure has been designed with the properties of typical polyethylene plastics in mind. Polyethylene plastic having a thickness of about 1/32" is resilient and slightly elastic, and is also stiff enough to support an appreciable load if used in a suitably designed load bearing structure.

The load bearing supporting structure must perform the following functions:

- support a static vertically oriented load (all or at least a portion the weight of the product);
- support a vertically oriented dynamic load due to vertically displaced motion of the product or outer package;
- support a horizontally oriented (in the other two dimensions) dynamic load due to horizontally displaced motion of the product or outer package;
- deform so as to cushion the product from high accelerative or decelerative forces, with such deformation being realized over as large a displacement as reasonably possible, so as to minimize the forces transmitted to and therefore absorbed by the product.

The product supporting structure of the present invention has been designed so as to have walls thick enough to support a static load of several pounds so that a product may be supported by the strength of the walls alone, and also to absorb the extra forces caused by dynamic loading.

The product supporting structure of the present invention has also been designed so as to have walls that are thin enough to be at least partially deformable under typical dynamic loading conditions, so that the overall structure will deform and thus absorb the force of the load over a relatively large displacement, at least as large as reasonably possible. Such large displacement deformation helps to minimize the deceleration forces encountered in receiving and supporting a load and in damping the motion of dynamic loading.

The walls must be thin enough to be resiliently and somewhat elastically deformable so that the structure will non-permanently deform under a static or dynamic load caused by the weight of the material and the movement of the material to be absorbed without permanently deforming the material. The elasticity allows the structure to return to its original shape after it has been deformed by a load, within limits. If the walls are too thick, then the structure will not deform by a significant a mount, and therefore will not be able to minimize the accelerative or decelerative forces imparted to it. Further, the structure will be less resilient and be more likely to be permanently deformed if it is deformed by at least a certain amount, and will be less likely to elastically return to its original shape.

The invention may be better understood from the following more detailed description of several specific embodiments, taken in the light of the accompanying drawing and the appended claims.

DETAILED DESCRIPTION

Figure 1:
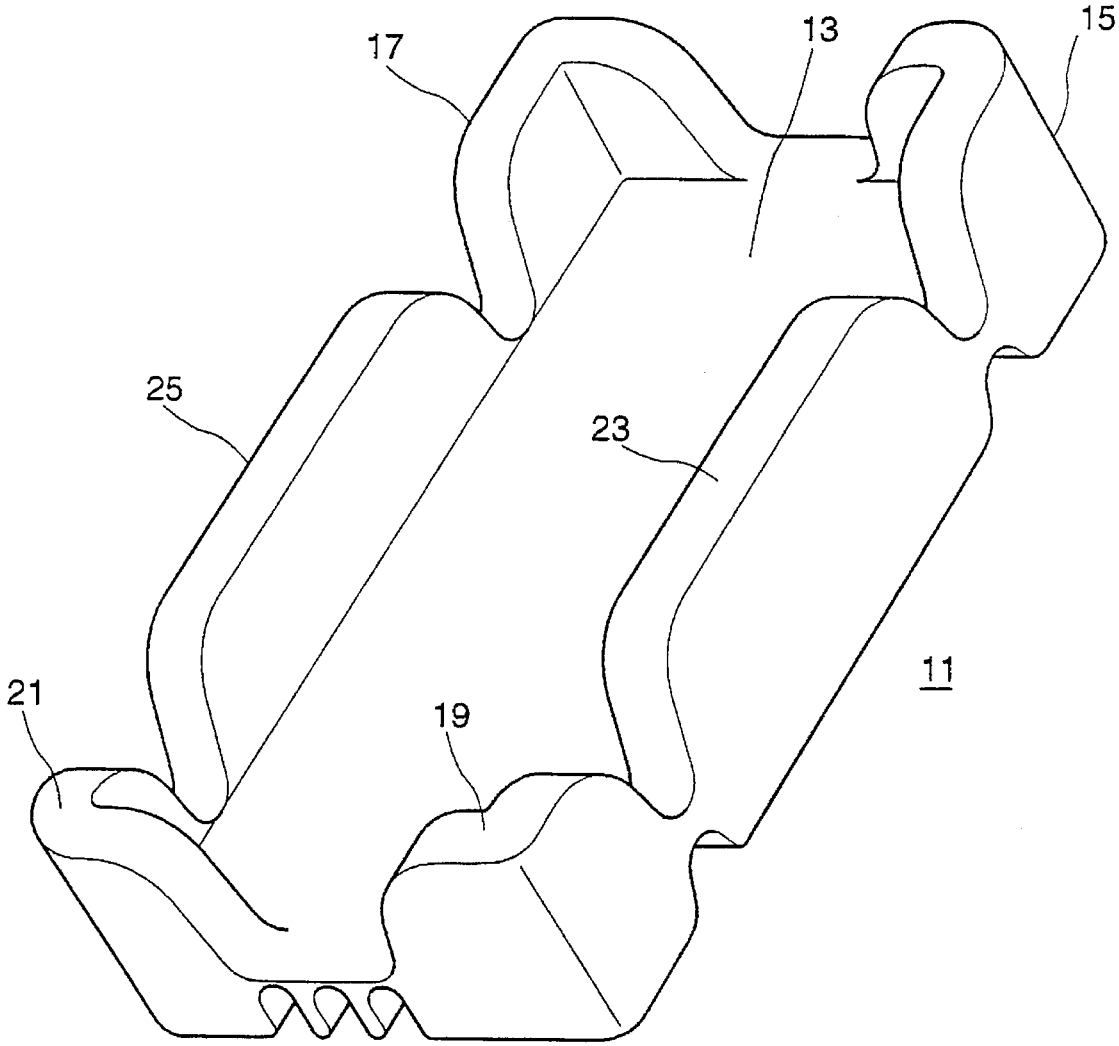
FIG. 1 illustrates a product supporting vertical end cap air bladder embodying various aspects of the invention.

In order to properly understand the present invention, it is necessary to first understand the applied physics of the situation where impact forces would be experienced by the outer package containing the product and also experienced by the supporting structures and the product itself. There are essentially two types of situations. The first situation involves an outer package in motion, which has been impacted by an external object that may or not be moving, and which decelerates the package. The second situation involves a package that may or may not be moving, and which is impacted by an external object that is moving which in turn accelerates the package. The former case is more common in the handling and shipment of packages of goods and typically occurs when a package is dropped. In either case, there is a change of speed of the package and of the product therein.

In the first situation, inertial forces of the product are transmitted to the supports, to the outer package and to the external object. The supporting structure absorbs as much as possible of the forces. The supporting structure transmits a force to the product, which causes the product to decelerate. In the second situation, accelerative forces are transmitted from the external object to the outer package, to the supports and then to the product. The supporting structure absorbs as much as the force as possible. Some of the force is transmitted to the product, which in turn accelerates the product.

In either case, there are forces transmitted to the product, and the product must absorb the energy being transmitted by these forces. If the forces are too high, damage to the product could result. It is therefore necessary to minimize the forces that reach the product so that it will not be damaged.

It must be realized that basically what is happening is that kinetic energy is being transferred to the product. When an outer package is hit by a moving external object, the kinetic energy of the external moving object must be absorbed. When an outer package is dropped and subsequently impacts onto to a surface such as a floor, the kinetic energy of the product inside at the time of the impact must be absorbed from the product by the supporting structure, and so on.

In order to absorb kinetic energy while realizing a minimum amount of force transmitted to the product, it is necessary to distribute the energy absorption over time as much as possible and to keep the acceleration and deceleration of the product as close to constant as possible. In order to accomplish this, it is necessary to, among other things, maximize the displacement over which the acceleration takes place. Thus, a relatively resilient supporting structure is preferable.

In use, when an object is introduced to the supporting structure, the relatively stiff yet resilient plastic that forms the supporting structure supports the initial weight loading of the object placed thereon. As more of the weight of the object is borne by the supporting structure, the weight of the object causes the structure to deform and correspondingly causes the pressure of the gas inside to increase. As the pressure of the gas inside the supporting structure increases, the gas provides a correspondingly increased support for the load. The structure continues to deform, in a resilient manner, until the resistive force provided by the supporting structure and the increased pressure of the gas therein are equal and opposite to the load thereon, and equilibrium is reached. In this manner, a relatively large displacement of the supporting structure is possible before equilibrium is reached, which provides relatively low supporting or damping forces for the object being supported.

In a dynamic load situation, the supporting structure and the pressure of the gas therein supports the changing load of a supporting object in a manner analogous to that described immediately above.

If the supporting structure were pressurized to a positive gauge pressure of perhaps 2–5 p.s.i., then the pressure of the gas in the supporting structure would help support the weight of a load placed on the supporting structure virtually as soon as the load is placed thereon. This means that there would be comparatively less displacement of the supporting structure when a load is placed thereon and correspondingly the load would not be damped over as great a distance—that is to say that the energy from the product being supported would be absorbed within a short distance and therefore over a relatively short period of time, which in turn would cause relatively high forces to be transmitted to the product, which may be undesirable.

In comparison if the supporting structure does not have a positive gauge pressure, then the structure would deform for a greater distance after receiving a load, all the while absorbing energy during the deformation due to the resiliency of the plastic. By the time the air pressure was sufficiently high to help support the load, the energy from the placement of the load would already be partially absorbed and correspondingly lower forces would be transmitted to the product.

FIG. 1 illustrates a typical application of the invention. In the protective packaging industry, vertical packaging elements are usually referred to as "end caps", while horizontal packaging elements are usually referred to as "trays". FIG. 1 shows one of a pair of "end caps" which may, for example, be used in the packaging of personal computers. In FIG. 1, an air bladder 11 forming the end cap is shown with a product receiving cavity 13 facing the viewer. Air bladder 11 is product specific in the sense that, once formed, a specific end cap will receive only a product with external dimensions matching the internal dimensions of cavity 13 and will only fit within shipping cartons matching its own external dimensions. Thus, in the illustrated application, the side of a personal computer may fit into the cavities 13 of a pair of air bladder end caps and the entire assembly may be placed in a snug fitting corrugated cardboard box (not shown) which serves as an outer shipping container. As an alternative, for instance when an inner container is desired for housing multiple products, the internal dimensions of cavity 13 may be made to match the external dimensions of that inner container. Such an alternative may be desirable when multiple products are to be packed within a single inner container, which is then given protective support within the outer shipping container. In a broad sense, the filled inner container then becomes the product to be stored or shipped.

As shown in FIG. 1, product receiving cavity 13 in air bladder 11 is bounded by four respective corner elements 15, 17, 19, and 21 and by two respective side walls 23 and 25. Although many examples of air bladder 11 will have corner elements, the need for side walls will depend a good deal upon the specific application. A relatively large product may, for example, require side walls between corner elements 15 and 17 and between corner elements 19 and 21. A relatively small product, on the other hand, may not require even the presence of side walls 23 and 25.

Air bladder 11 in FIG. 1 is, in accordance with an important aspect of the invention, composed of a suitable plastic resin material, such as polyethylene, and is produced by a blow molding process to form the illustrated end cap. In that process, a semi-solid tube of the plastic resin material is extruded into a mold that has the shape of the product's outer wall. In the instance illustrated, the shape is that of the outer wall of a personal computer. After the mold is closed, a blast of high pressure air through one or more holes in the wall of the mold forces the plastic tube to expand and contact the metal walls of the mold. The plastic resin then cools and hardens as the mold is cooled by circulating water through internal cavities in the mold. In an application such as that illustrated in FIG. 1, air bladder end cap 11 is pressurized during the blow molding process to a gauge pressure of about 3 to 5 pounds per square inch.

Figure 2B:
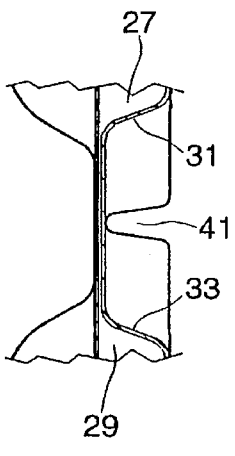
FIGS. 2A, 2B, and 2C are cross-sectional views of the end cap air bladder shown in FIG. 2.
Figure 2A:
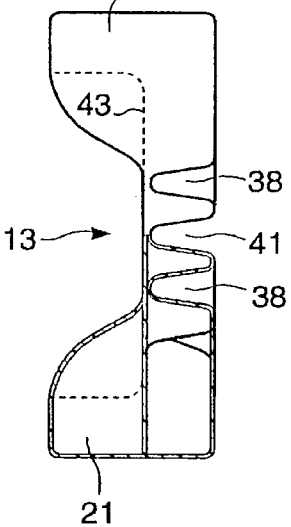
Figure 2C:
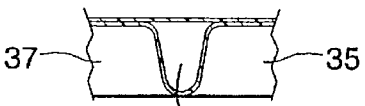
Figure 2:
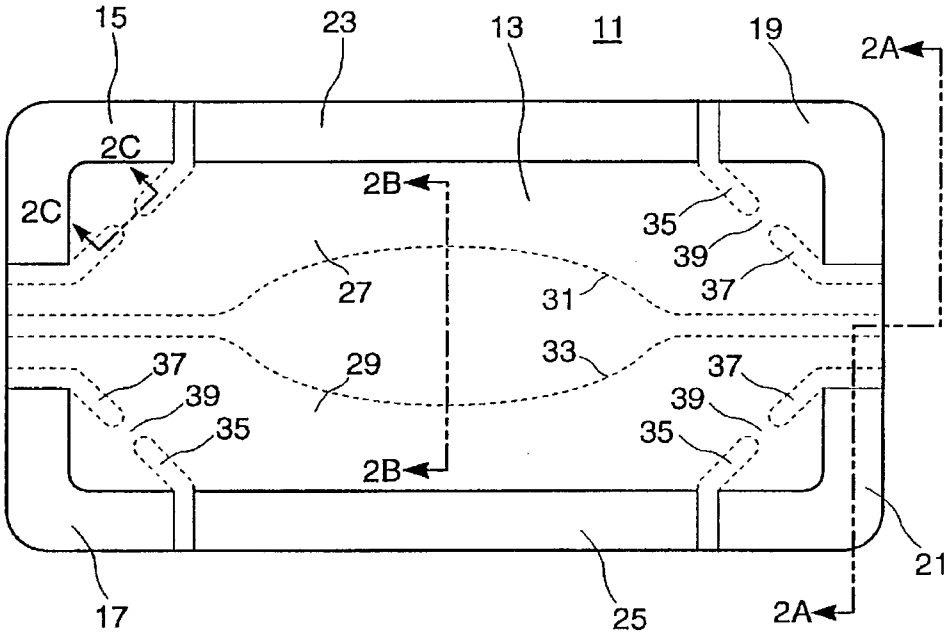
FIG. 2 is a plan view showing details of the end cap air bladder illustrated in FIG. 1.

FIG. 2 is a plan view of end cap air bladder 11 of FIG. 1 with the side of air bladder 11 forming cavity 13 shown facing the viewer. FIG. 2 illustrates several details not shown in FIG. 1, one being the division of air bladder 11 into two separately sealed main chambers 27 and 29, bounded by the exterior dimensions of the air bladder and by side walls 31 and 33, which are indicated by respective dashed lines. Chambers 27 and 29 are thus separated from one another in the vertical plane because of the vertical orientation of air bladder 11. Without the separation, the weight of the product (a computer in this instance) would compress the air in lower chamber 29 into upper chamber 27, resulting in a partial collapse of lower side wall 25 and lower corner elements 17 and 21.

Although main chambers 27 and 29 within air bladder 11 in FIG. 2 are sealed from one another, the invention makes it possible to provide sub-chambers within main chambers. Such sub-chambers are partially segregated from other chambers in order to provide a controllable shock damping effect. Examples of such sub-chambers are corner elements 15, 17, 19, and 21 in FIG. 2. Comer element 15 is molded to be a corner baffling sub-chamber, defined by the outer walls of air bladder 11 and by fingers or protrusions 35 and 37 extending from the outside of air bladder 11 into the interior until they nearly contact one another. The gap 39 left between protrusions 35 and 37 permits the passage of air between the corner baffling chamber and main chamber 27 but only at a relatively slow rate. The degree of isolation of the sub-chamber forming corner element 15 is controlled by the size of gap 39.

As shown in FIG. 2, remaining corner elements 17, 19, and 21 are similarly constructed and provide corner baffling sub-chambers which operate in a similar manner. Extra shock protection is provided in this manner at respective corners of the ultimate shipping package. In the interest of clarity, reference numerals 35, 37, and 39 are used to denote corresponding components in all four corner elements in FIG. 2.

FIG. 2A is cross-sectional view of air bladder 11 in FIG. 2, taken along the line A—A, which is broken at the center in order to show details of both exterior and interior construction. Recess 41 in FIG. 2A marks the end of side walls 31 and 33 separating upper and lower chambers 27 and 29. The matching recesses 38 mark the ends of the similarly numbered protrusions into those chambers to provide restricted air flow between upper and lower chambers 27 and 29 and their respective ones of corner sub-chamber elements 19 and 21.

FIG. 2B is another cross-sectional view of air bladder 11 in FIG. 2, this time taken along the line B—B. Here, dividing walls 31 and 33 are farthest apart from one another. Portions of upper and lower chambers 27 and 29 are shown, as is recess 41 at the other end of air bladder 11.

FIG. 2C is yet another cross-sectional view of air bladder 11, this time taken along the line C—C. Here, the ends of protrusions 35 and 37 into the interior of air bladder 11 are shown, along with gap 39 which is provided between them to provide for the restricted flow of air needed for corner damping.

Figure 2D:
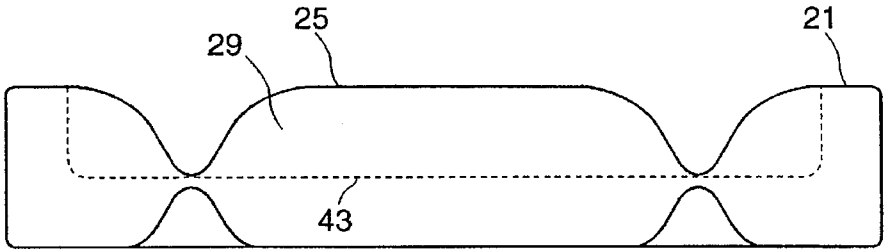
FIG. 2D is a side view of the end cap air bladder shown in FIG. 2.

FIG. 2D, finally, is a side view of air bladder 11, with side wall 25 and corner elements 17 and 21 facing the viewer. Dashed lines 43 marks the bottom and ends of product supporting cavity 13 of air bladder 11.

Figure 3:
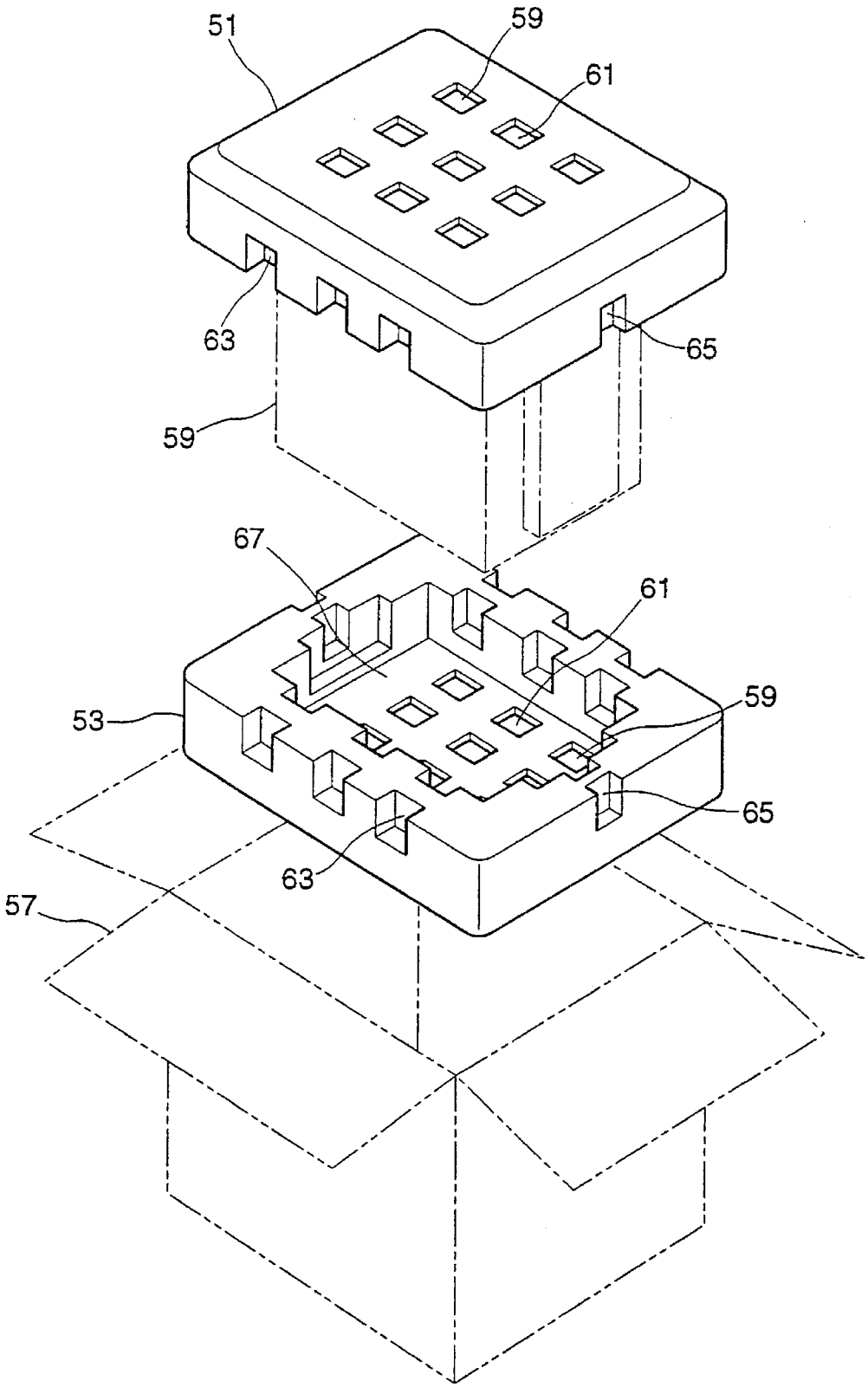
FIG. 3 illustrates product supporting horizontal tray air bladders embodying various aspects of the invention.

FIG. 3 illustrates another typical application of the invention, this time providing horizontal trays for packaging a product such as a television set. In FIG. 3, a first air bladder 51 forms an upper tray and a second air bladder 53 a lower tray. The two air bladder trays provide respective top and bottom support for a product 55 (shown by dashed lines) within a corrugated cardboard outer shipping container 57 (also shown by dashed lines). Air bladder trays 51 and 53 are shown as mirror images of one another in this particular example, for purposes of clarity, but need not be identical as a general proposition.

In FIG. 3, holes 59 and 61 are an example of a number of holes extending entirely through respective air bladder trays 51 and 53 to constrict the passage of air between various sections of their single main interior chambers by forming sub-chambers. Protrusions 63 and 65, similarly, are examples of protrusions extending partially into respective air bladder trays 51 and 53 both from the exterior of the air bladders and from the product supporting cavities to perform a similar purpose. In FIG. 3, a product supporting cavity 67 in lower air bladder tray 53 faces up, while a similar product supporting cavity (not seen) in upper air bladder tray 51 faces downward.

In a horizontal application of the invention such as that shown in FIG. 3, it is sometimes advantageous to manufacture respective air bladder trays 51 and 53 initially slightly deflated. Such slight deflation simplifies the packing process in that the deflated and hence slightly undersized air bladders will more easily fit into corrugated cardboard outer container 57. After product 55 and the two slightly deflated air bladder trays 51 and 53 are installed within container 57 and container 57 is sealed, air bladder trays 51 and 53 may be further inflated directly through corrugated cardboard container 57 with an inflation gun, an example of which is shown in FIG. 4.

Figure 4A:
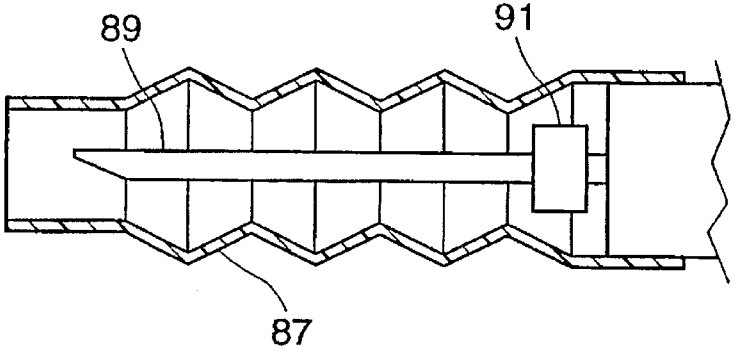
FIG. 4A illustrates tip details of the inflation gun shown in FIG. 4.
Figure 4:
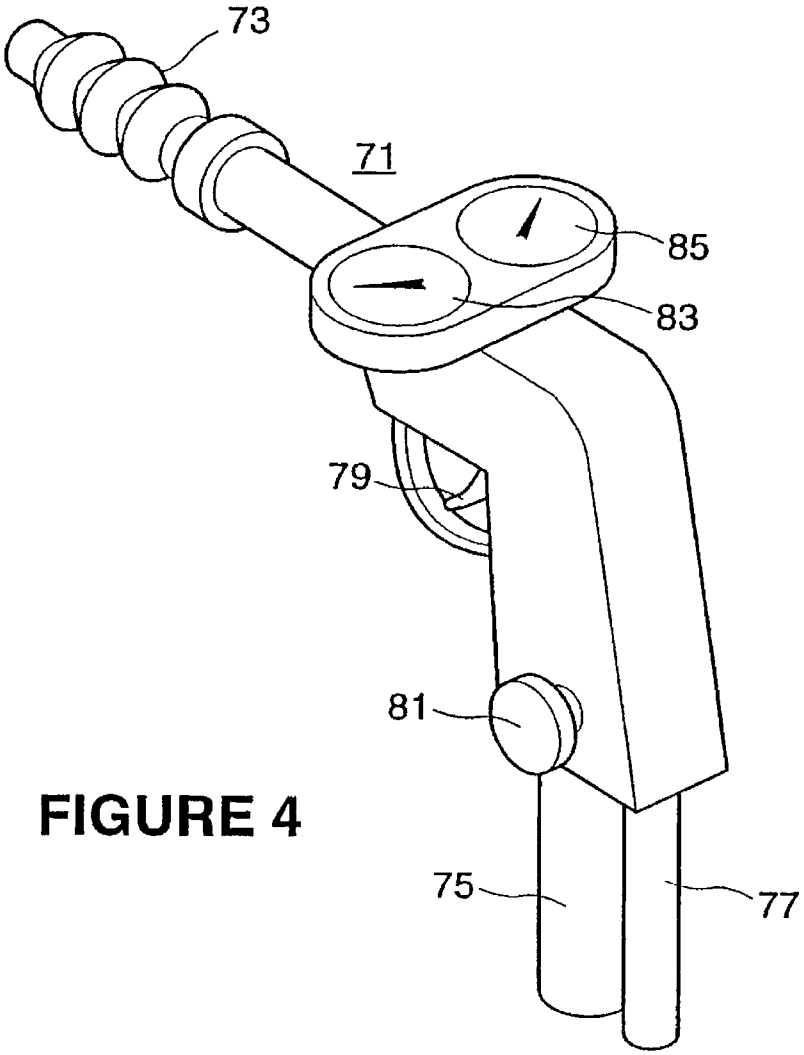
FIG. 4 shows an inflation gun suitable for post molding inflation of air bladders embodying various aspects of the invention.

In FIG. 4, an inflation gun 71 is essentially an air valve connected to a hollow needle upon which there is a small heater element installed within a gun tip 73. Inflation gun 71 is connected to a regulated air supply (not shown) through an air line 75, and to a variable power source (not shown) through a power line 77 to control the needle temperature. A trigger mechanism 79 on the handle of gun 71 provides the user with on-off control and a heat adjust knob 81 (also on the handle) permits accurate control of the heater element within gun tip 73. An air pressure gauge 83 and a heat gauge 85 complete the combination.

Details of inflation gun tip 73 in FIG. 4 are shown in FIG. 4A. Gun tip 73 is composed of a neoprene bellows 87 which surrounds a hollow air and heater needle 89 and a heater coil 91. Heater coil 91 encircles the base of needle 89 and bellows 87 compresses upon itself to expose needle 89 when the user presses the gun against an intended target such as outer container 57 in FIG. 3.

In practice, when in the idle mode, needle 89 in FIG. 4A remains at a temperature approximately ten percent higher than the melting temperature of the plastic air bladder material. Outer packing container 57 in FIG. 3 may have pre-printed inflation point instructions and markings of locations where the needle is to be forced through corrugated cardboard container 57 and into the air bladder. By way of example, in the areas where the extruded plastic tube is pinched off and sealed, the air bladder walls are often three to four times thicker than the walls of the rest of the bladder. Such areas, generally, are good post-assembly inflation points. Pressing trigger 79 in FIG. 4, will inflate the bladder to preset pressure level. In order to keep needle 89 from continuing to melt the bladder and creating an oversize opening during the five to ten second filing time, incoming air is relied upon to drop the temperature of needle 89 quickly below the melting point of the plastic bladder material. Once the preset pressure is reached and incoming air stops, needle 89 quickly cycles back up to temperature, allowing it to remelt the plastic to ease its withdrawal. As needle 89 withdraws, internal bladder pressure pushes some of the melted plastic into the hole left by the needle and reseals the bladder.

Upon final disassembly when the shipped product reached its destination, graphic instructions on the bladder itself may be used to instruct the consumer to puncture the bladder for easy removal of the product as well as to provide either general or specific disposal and recycling instructions.

Figure 5:
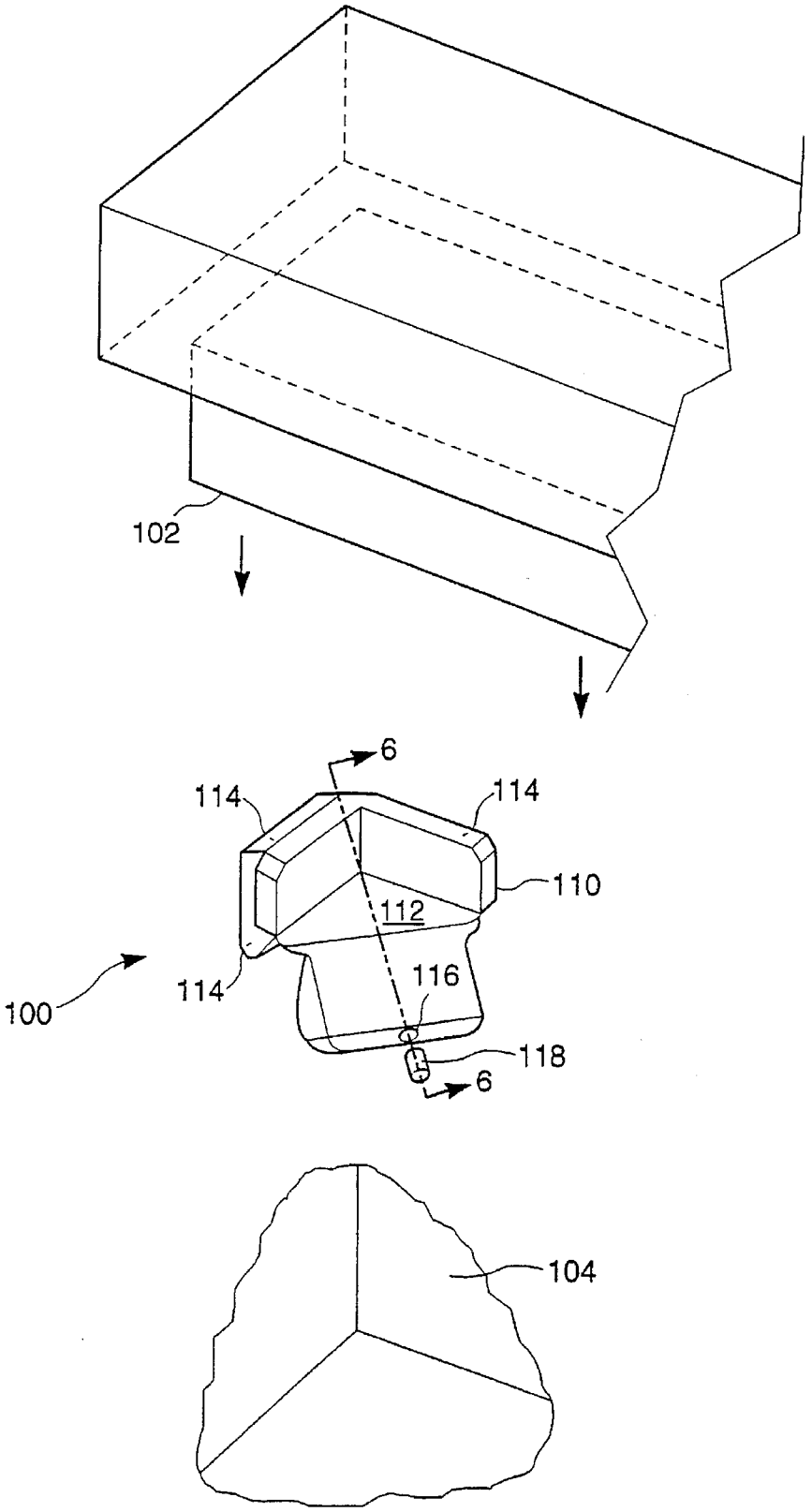
FIG. 5 is an exploded isometric view of a further specific embodiment of the present invention showing a discrete product supporting structure co-operating with the corner of a product and the corner of an outer package.

Reference will now be made to FIG. 5, which shows an alternative embodiment of the present invention. In this alternative embodiment, a supporting structure 100 is used to position and support a product 102 within an outer packing container 104. Typically, a total of eight such supporting structures 100 would be used, one in each corner of the product 102. The product supporting structure 100 supports the product 102 at a predetermined portion thereof. The supporting structure 100 has a predetermined configuration and predetermined dimensions such that it supports the product at the predetermined portion—which is of a predetermined configuration. Further, the outer packing container 104 has a predetermined configuration, with the supporting structure 100 to be placed at a predetermined portion thereof.

When in use in combination with the product 102 and the outer packing container 104, the supporting structure comprises a gas-containing bladder 110 that has a product receiving portion 112 in a first region of the gas-containing bladder 110. The product receiving portion 112 has a predetermined configuration and dimensions so as to be co-operative with the predetermined portion of the product 102 and so as to receive in generally intimate and cooperating relation thereto the predetermined configuration of the predetermined portion of the product 102. The predetermined configuration and dimensions of the supporting structure 100 are adapted to fit the predetermined configuration of the predetermined portion of the product. Typically, the predetermined portion of the product is a portion of a corner of the product 102.

The gas-containing bladder 110 has a package containing portion 114 in a second region thereof. The second region is remote from and generally opposed to the first region. The package containing portion 114 is such as to be co-operative with the predetermined configuration of the outer packing container 104.

The supporting structure 100 has a predetermined size and shape when it is manufactured. The supporting structure 100 is typically manufactured with an opening 116 therein. A plug 118 is adapted to fit into the opening in sealed relation thereto and is inserted therein either immediately after: manufacture or just before use. Thus, a sealable opening into the gas-containing bladder 110 is provided. When the plug 118 is in place, the gas-containing bladder 110 is sealed to its ambient surroundings. For shipping purposes, the supporting structure may be shipped without the plug in, in which case it is somewhat collapsible if necessary, or it may be shipped with the plug 118 in the opening 116. The supporting structure 100 retains its size and shape when the gauge pressure of the gas within the gas-containing bladder 100 is zero, irrespective of whether the gas-containing bladder 110 is sealed or open to the ambient surroundings.

The supporting structure 100 is capable of supporting a load thereon even when the interior of the gas-containing bladder 110 is in fluid communication with the ambient surroundings.

The gas-containing bladder 110 may be sealed so as to have a gauge pressure of the gas therein that is about zero. This will allow for relatively soft cushioned damping of the product 102. It is also possible to pressurize the gas-containing bladder 110 to a gauge pressure above zero, typically within a range of about 0.01 to about 2.0 atmospheres. Such additional gas pressure would cause the air bladder 110 to provide firmer damping for the product 102.

In a further alternative embodiment of the invention, the predetermined configuration and dimensions of the supporting structure 100 may be adapted to fit a predetermined configuration of a predetermined portion of a product, with the predetermined portion of the product being an edge of the product. For example, a long slender item may be supported at its centre, or a plate or a dram at selected places around its circumference.

Preferably, the supporting structure 100 is made of a plastics material having an average wall thickness in the order of about 1/32 of an inch. The material that forms the supporting structure 100 can be chosen from the group consisting of polyethylene, polypropylene, and co-polymers thereof; as well as vinyl, polyvinylchloride, or nylon. The gas within the gas-containing bladder 110 is most commonly air, but also may be chosen from the group consisting of nitrogen, carbon dioxide, sulphur hexafluoride, argon and krypton.

The gas-containing bladder 110 may comprise a plurality of discrete chambers therein, with the discrete chambers being in fluid communication with one another through small openings, which are means for restricting gas flow between chambers. These openings allow a small amount of gas to pass therethrough in a given time, thereby providing a baffling effect which ultimately aids in the cushioning effect provided by the gas-containing bladder 110. Preferably, contiguous chambers within the gas-containing bladder are in fluid communication with one another.

Figure 6:
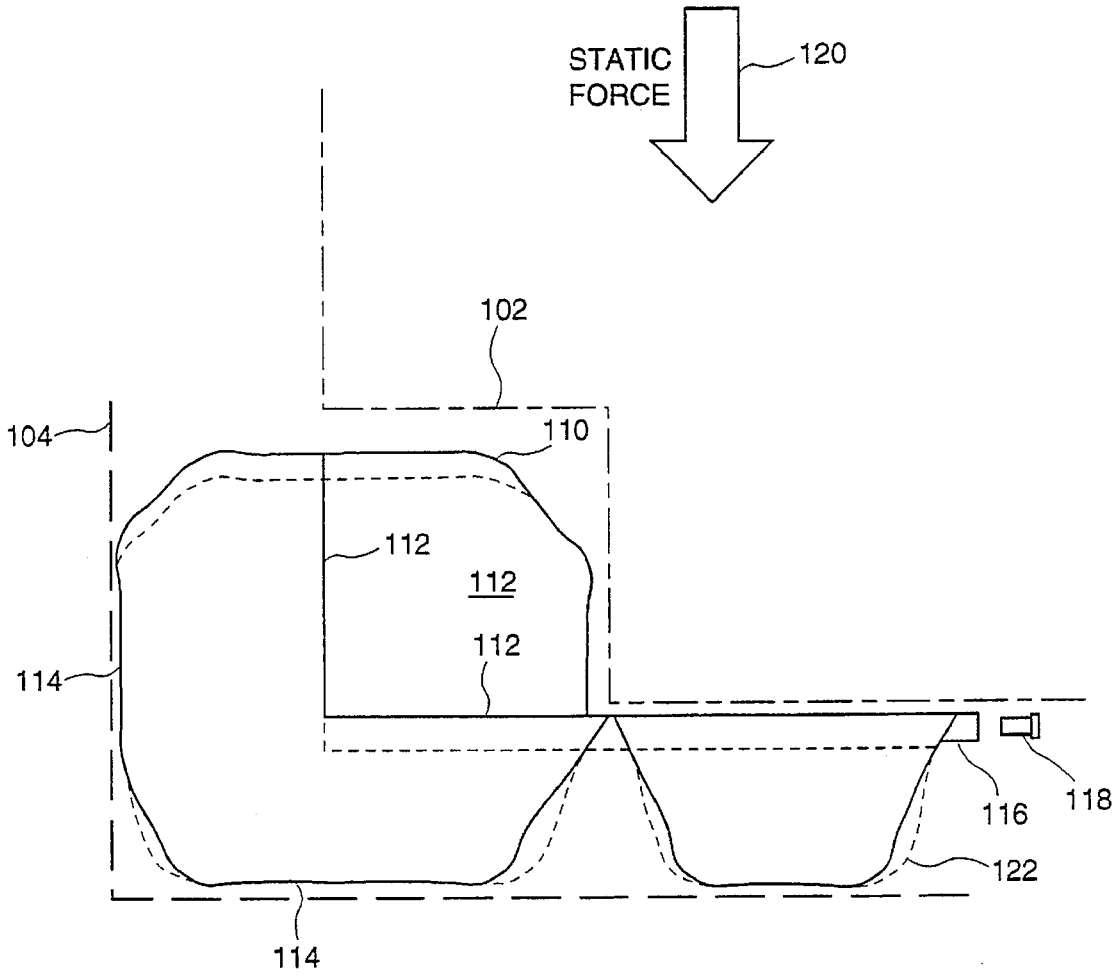
FIG. 6 is a cross-sectional view of the product supporting structure of FIG. 5.

Reference will now be made to FIG. 6 which shows the supporting structure 100 of the present invention having the product 102 placed thereon. It can be seen that the portion of the product 102 that is supported by the supporting structure 100 is a somewhat complicated shape, and the predetermined configuration and dimensions of the supporting structure are adapted to fit to the predetermined configuration of the predetermined portion of this product. When the product 102 is placed on the supporting structure 100, there is a static force, indicated by arrow 120, which of course is in a downward direction. This static force 120 causes the supporting structure 100 to deform somewhat as shown by the dash lines 122. If, as usual, the gas-containing bladder 110 is sealed, then the deformation causes an increase in pressure of the gas within the gas-containing bladder 110.

It is to be understood that the embodiments of the invention which have been described are illustrative. Numerous other arrangements and modifications may be readily devised by those skilled in the art without departing from the spirit and scope of the invention.

We claim:

1. In combination, an outer packing container and a supporting structure for positioning and supporting a product within the outer packing container, said supporting structure comprising:

a blow-molded semi-rigid and self-supporting monolithic gas-containing bladder being formed from walls that are resiliently and elastically deformable under dynamic loading conditions while being strong enough to support a static load from the product, said bladder including a plurality of discrete chambers which are elastically deformable and self-supporting, each chamber being in fluid communication with at least one other chamber, said bladder providing a preformed product receiving portion in a first region, and;

a packing container contacting portion in a second region of said bladder which is remote from and generally opposed to said first region;

wherein at least one of said plurality of discrete chambers is unsealed and is open to the ambient atmosphere, is elastically deformable, and supports a product load imposed thereon in static load supporting conditions thereof and substantially retains its predetermined configuration and dimensions; and wherein said self-supporting gas-containing bladder supports a product load imposed thereon in dynamic load supporting conditions thereof and substantially retains its predetermined configuration and dimensions.

2. The combination of claim 1, wherein said predetermined configuration and dimensions of said supporting structure conform to said predetermined configuration of said predetermined portion of said product, and wherein said predetermined portion of said product is a portion of a corner of said product.

3. The combination of claim 1, wherein said predetermined configuration and dimensions of said supporting structure conform to said predetermined portion of said product, and wherein said predetermined portion of said product is a portion of an edge of said product.

4. The combination of claim 1, wherein said supporting structure is made of a plastics material having an average wall thickness of about 1/32 inch.

5. The combination of claim 4, wherein the material that forms said supporting structure is chosen from the group of blow moldable plastics consisting of polyethylene, polypropylene and co-polymers thereof, vinyl, polyvinylchloride and nylon.

6. The combination of claim 1, wherein the gas in said gas-containing bladder is a damping gas chosen from the group of pressurizable gasses consisting of air, nitrogen, carbon dioxide, sulphur hexaflouride, argon and krypton.

7. The combination of claim 1, wherein the gas in said gas-containing bladder is air.

8. The combination of claim 1, wherein at least an adjacent pair of said plurality of discrete chambers in said gas-containing bladder are in fluid communication with one another.

9. The combination of claim 1, further including means for restricting gas flow between chambers, wherein said means are dimensioned so as to at least partially constrict said fluid communication.

10. The supporting structure of claim 1, in which:

said gas-containing bladder contains a plurality of interior chambers, at least one of which is in fluid communication with said at least one of said plurality of discrete chambers which is unsealed and open to the ambient atmosphere.

11. The supporting structure of claim 1, in which:

said plurality of discrete chambers is formed by baffle members extending into the interior of said gas-containing bladder, wherein a damping effect on gas moving from one of said discrete chambers to another is exerted by said baffle members.

12. The supporting structure of claim 1, in which:

said plurality of discrete chamber is formed by baffle members extending into the interior of said gas-containing bladder, whereby a damping effect on gas moving from one of said discrete chambers to another is exerted by said baffle members; and wherein said supporting structure has a plurality of corners, and at least one of said interior sub-chambers is positioned at at least one of said corners.

13. A supporting structure for positioning and supporting a product during storage and shipping, wherein the product to be supported has predetermined external dimensions; and wherein said supporting structure comprises:

a semi-rigid and self-supporting polymer resin gas-containing bladder incorporating a plurality of discrete inflatable chambers and at least one means for fluid communication between each of said chambers, wherein at least one of said plurality of discrete chambers is unsealed and is open to the ambient atmosphere;

wherein said bladder has a preformed product receiving cavity with a predetermined configuration which is independent of pressure within said bladder, and where said predetermined configuration is such as to fit at least a portion of said predetermined external dimensions of the product to be supported;

wherein said ass-containing bladder is deformable and substantially retains its preformed configuration under static load-bearing conditions; and wherein said gas-containing bladder is deformable and sufficiently resilient, so as to substantially retain its preformed configuration under dynamic load-bearing conditions, so as to minimize accelerative or decelerative forces from forces applied to said gas-containing bladder and thereby so as to minimize transmission of kinetic energy to said product while under dynamic load-bearing conditions.

14. The protective packaging of claim 13, wherein there are a plurality of contiguous chambers which are in fluid communication with one another, and at least one of said plurality of contiguous chambers is unsealed and is open to the ambient atmosphere.

15. The protective packaging of claim 13, wherein the monolith has a preformed product receiving portion having a predetermined configuration and dimensions so as to be cooperative with a predetermined portion of a product and so as to receive said predetermined configuration of said predetermined portion of said product.

16. The protective packaging of claim 15, wherein the monolith defines a packing container contracting portion which is remote from and generally opposed to said product receiving portion, said packing container contacting potion being dimensioned to conform with an outer packing container.

17. The supporting structure of claim 13, wherein said polymer resin is chosen from the group consisting of polyethylene, polypropylene and co-polymers thereof, vinyl, polyvinylchloride and nylon.

18. The supporting structure of claim 13, wherein the gas in said gas-containing bladder is a damping gas chosen from the group of pressurizable gasses consisting of air, nitrogen, carbon dioxide, sulphur hexafluoride, argon and krypton.

19. The supporting structure of claim 13, wherein the gas in said gas-containing bladder is air.

* * * * *